United States Patent [19]

Henrich

[11] Patent Number: 4,840,317

[45] Date of Patent: Jun. 20, 1989

[54] WOOD PULP GRINDER

[75] Inventor: Hans-Otto Henrich, Hiedenheim, Fed. Rep. of Germany

[73] Assignee: J. M. Voith GmbH, Fed. Rep. of Germany

[21] Appl. No.: 112,252

[22] Filed: Oct. 22, 1987

[30] Foreign Application Priority Data

Oct. 24, 1986 [DE] Fed. Rep. of Germany ..... 3636226

[51] Int. Cl.[4] ..... B02C 19/12

[52] U.S. Cl. ..... 241/282

[58] Field of Search ..... 241/28, 280, 281, 282

[56] References Cited

U.S. PATENT DOCUMENTS 1,359,016 11/1920 Baker ..... 241/282 X 4,664,323 5/1987 Ahonen et al. ..... 241/282

FOREIGN PATENT DOCUMENTS 548889 3/1903 Fed. Rep. of Germany ..... 241/282

297810 5/1917 Fed. Rep. of Germany ..... 241/282

*Primary Examiner*—Mark Rosenbaum

*Attorney, Agent, or Firm*—Ostrolenk, Faber, Gerb & Soffen

[57] ABSTRACT

A wood pulp grinder includes a grinder housing for supporting wood to be ground above a grindstone. A main press chamber in the grinder housing supports a main press ram which moves toward and away from the grindstone. When the main press ram is upraised, the main press chamber is charged with wood to be ground. Adjacent one or both circumferential sides of the main press chamber is disposed a respective auxiliary press ram with is movable toward the grindstone independently of the motion of the main press ram for retaining pressure upon the wood in the grinder housing while the main press ram is not pressing upon the wood. The auxiliary press ram or rams are relatively long in a lengthwise direction, having a length equal to fifty percent and preferably at least eighty percent of their active press stroke. The active lower surface of the auxiliary press ram may be inclined generally in a direction tangent to the surface of the grindstone or may be curved convexly toward the grindstone. When the main press ram is being retracted for reloading the press chamber, a closure plate moves across the bottom of the press chamber for preventing reverse movement of the wood.

20 Claims, 2 Drawing Sheets

WOOD PULP GRINDER

BACKGROUND OF THE INVENTION

The present invention relates to a wood pulp grinder designed for maintaining pressure upon the wood in the grinder during loading of additional wood for being ground, and particularly to an arrangement including a plurality of independently operable press rams in the grinder housing for accomplishing that purpose.

Such a wood pulp grinder is known from German Pat. No. 297,810. In that wood pulp grinder, there are two parallel press rams, each guided in a respective pressing chamber. Those chambers also serve as loading chambers for the wood bolts, in order to feed them to the common grinder magazine. These press rams are acted on alternately by pressure. As a result of the propagation of the pressure in the pile of wood which is present in the press magazine and forms a heap, the pressure is propagated from bolt to bolt of wood to the surface of the grindstone.

In this connection, the press rams are withdrawn into the upper pressing position for the loading of the wood. After lowering of the other press ram upon its work stroke, the work stroke of the press ram which is associated with the individual magazine which has just been loaded is introduced. It is advisable to charge each individual magazine of the individual press rams in the direction parallel to the axial direction of the grindstone. Otherwise, dependable loading of the individual magazines would not be possible. The spacing near the grindstone of the lower edge of the central wall of the press magazines which is arranged between those magazines, i.e. which lower edge is also the bottom end of the stroke of the press rams, is, of course, to be so selected here that, corresponding to the angle of slope for the course of the pressure, the grinding pressure, exerted by a press ram can also spread out over the entire width of the press magazine in the region of the surface of the grindstone.

This arrangement has the disadvantage that the two individual magazines associated with the two respective individual press rams must be charged individually with the wooden bolts so that a separate respective charging apparatus is necessary for both of them. Furthermore, in order to assure the full pressing pressure and its uniformity upon each work stroke, closure plates must be provided in the region close to the grindstone on the individual magazine associated with each individual press ram. These are not mentioned in the patent.

SUMMARY OF THE INVENTION

The object of the present invention is to provide a wood pulp grinder requiring only a single charging device for the press magazine.

Another object of the invention is to maintain the pressure upon the wood in the grinder housing at at least a predetermined level while a main press chamber is being charged with additional wood to be ground and while the main press ram is actively pressing the wood toward the grindstone.

A further object of the invention is to accomplish the foregoing objects using a plurality of rams in the grinder housing which all cooperate for maintaining pressure.

According to the invention, the grinder housing has an open end at the peripheral surface of the rotating grindstone at which the wood is pressed against the grindstone. Spaced up away from the grindstone is a main press chamber which is charged periodically with wood to be ground. A press ram is movable in the main press chamber toward and away from the grindstone. A cover plate is movable across generally the bottom end of the main press chamber for preventing wood from returning into the main press chamber upon retraction of the press ram therethrough.

Also in the grinder housing and preferably adjacent to and arranged parallel to the main press ram is at least one circumferentially offset auxiliary press ram which moves toward and away from the grindstone independently of the main press ram. The auxiliary press ram is operated to maintain pressure upon the wood in the grinding chamber when the main press ram is retracted, as in preparation for loading additional wood into the main press chamber. The auxiliary press ram has an active lower surface which is located, at least at the beginning of its active pressing stroke toward the grinding stone, near the bottom end of the stroke of the main press ram and near the bottom of the wall of the main press chamber. The auxiliary press ram is preferably located adjacent the main press chamber. The auxiliary press ram has a length, measured in the direction of its path of travel toward and away from the grindstone, that is equal to at least one-half the length of the active pressing stroke of that press ram and preferably equal to at least eighty percent of that pressing stroke. Further, the active pressing stroke of the auxiliary ram or rams is preferably at least one-half as great as the length of the active pressing stroke of the main ram.

The active pressing surface of the auxiliary rams is preferably oblique to the direction of motion of the auxiliary rams and is preferably oriented in a direction that would be tangent to the surface of the grindstone on the region of the grindstone at which a projection of the auxiliary ram would fall, that is the surface that would be contacted by the auxiliary ram if it moved all the way to the grindstone. This produces the largest possible component of pressing force by the auxiliary ram toward the axis of the grindstone.

In an alternate arrangement, the obliquely inclined active pressing surface of the auxiliary ram, at least in its region close to the main pressing chamber, has a large radius curvature toward the main press chamber. This radius may amount to at least four-fifths of the width of the auxiliary rams, measured transversely to the axis of the grindstone.

There may be two auxiliary press rams, one on each circumferential side of the main press chamber. The two auxiliary press rams are advanced and retracted simultaneously, independently of the main press ram.

In an alternate design, each auxiliary press ram may be developed as a laterally open box construction, open on the lateral sides axially of the grindstone.

Other objects and features of the invention will be explained below with reference to an embodiment which is shown in the drawings.

DESCRIPTION OF THE PREFERRED EMBODIMENTS

Figure 1:
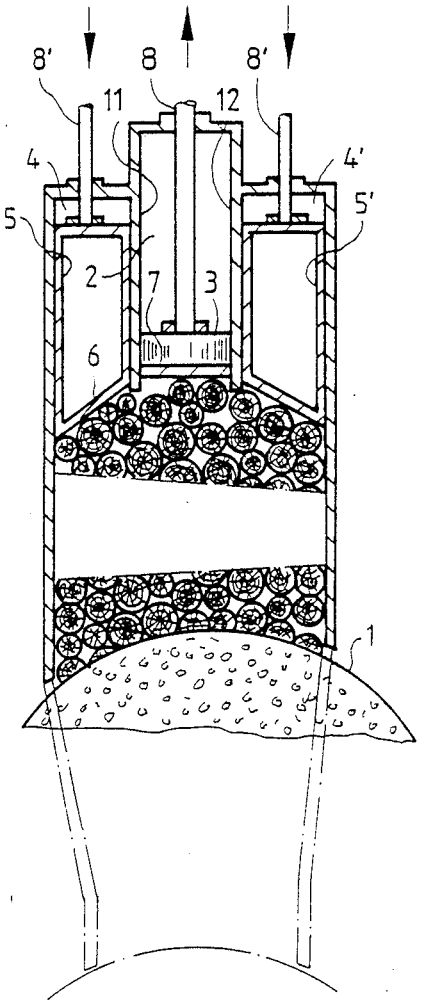
FIG. 1 is an elevational cross section through the wood pulp grinder.

In FIG. 1, the main press chamber 2 in which the main press ram 3 is arranged lies in the center of the magazine arrangement, circumferentially around the grind stone 1. The ram 3 is adapted to be displaced vertically, i.e. radially of the grindstone, by the push rod 8. The drives for the main and auxiliary press rams 3, 5, 5' have been omitted in each case. They are generally known hydraulic servomotors.

Laterally alongside in circumferential directions from the main press chamber 2, there are auxiliary press chambers 4 and 4' each having a respective auxiliary press ram 5 and 5' associated individually with it. Rams 5, 5' are driven vertically in similar manner by push rods 8'. The inner chamber walls 11, 12 are both parts of the main press chamber 2 and at the same time also form the inner walls of the auxiliary press chambers 4 and 4'. The length, measured in the axial direction, i.e. the direction of their strokes, of the auxiliary press rams 5 is preferably approximately equal to their effective pressing strokes and, in general, to their strokes as a whole. The length of the active strokes of the auxiliary press rams 5 is at least one-half the length of the active stroke of the main press ram.

The positions of the auxiliary press rams 5 and 5' shown in FIG. 1 are their initial positions prior to their pressing strokes, i.e. the beginning of the pressing of the wood by these press rams. To the extent that the auxiliary press rams 5 and 5' are moved downward, i.e. toward the grindstone, the main press ram 3 may be retracted without any change in the pressure acting in the heap of wood bolts. For this purpose, a closure plate 7 is preferably pushed below the main press ram 3 before that ram is retracted so that the wood bolts are prevented from moving upward. After the main press ram 3 has been completely retracted, the main press chamber 2 is loaded again with bolts of woods, the closure plate 7 is again pulled out of the press magazine and the work stroke of the main press ram 3 commences. The auxiliary press rams 5 and 5' are again moved back simultaneously, also in a manner such that the pressure on the bolts of wood remains substantially unchanged.

The lower active surfaces 6 and 17, respectively, of the auxiliary press rams, are inclined. Each is substantially parallel to a tangent to the surface of the grindstone in the region where the projection along the direction of the push rods of the auxiliary press rams comes on to the surface of the grindstone. The inclinations of the lower active surfaces may be selected to be somewhat different from the tangent since the inclination is selected to produce the largest possible component of force in the direction toward the axis of the grindstone or the top most point of the surface of the grindstone. This assures that the pressure acts as uniformly as possible in the pile of wooden bolts over the entire grinding zone.

Figure 2A:
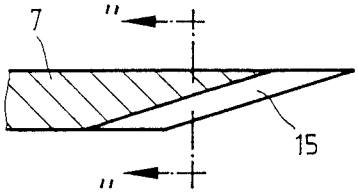
FIG. 2*a* is a partial longitudinal section through the closure plate of the main press chamber.
Figure 2B:
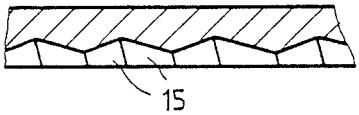
FIG. 2*b* is a cross section through the closure plate of the main press chamber.

The pushing of the closure plate 7 into position is to take place, insofar as possible, under the operating pressure of the main press ram 3. The edge of the plate 7 which lies toward the front of the closing movement is therefore sharpened. As shown in FIGS. 2*a* and 2*b*, the front edge of plate 7 preferably has a long inclined surface which is provided with file-like or rasp-like teeth 15 to rasp off the surface of the bolts of wood over which the closure plate slides and thus to reduce the resistance of the pushing-in of the closure plate. The chips and the emerging moisture of the wood on the rasped surfaces leads here to reduced frictional resistance. Of course, the pressing pressure of the press rams could also be removed or reduced for a short time to ease insertion of the plate 7.

Figure 3:
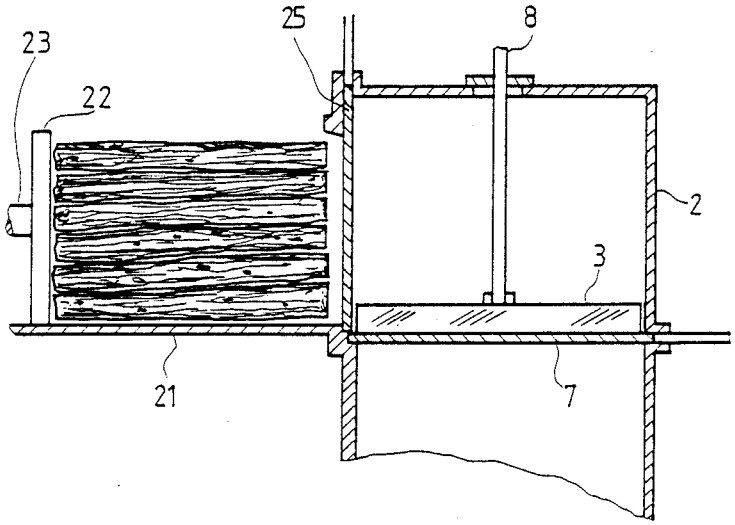
FIG. 3 is a side cross section of the grinder.

FIG. 3 is a side cross sectional view of the press grinder in the region of the main press ram 3. A wood-advance tray 21 is provided. It forms part of a wood-advance chamber which in this case is open on top. The bolts of wood are stored on tray 21 with their longitudinal direction parallel to the axis of the grindstone 1. They are introduced into the main press chamber 2 by press ram 22, actuated by piston rod 23. After this introduction, the main press chamber 2 is closed by the lateral, vertically shiftable slide 25, which can also be sealed in pressure-tight manner in the event that an excess pressure is to be maintained in the grinder housing.

Figure 4:
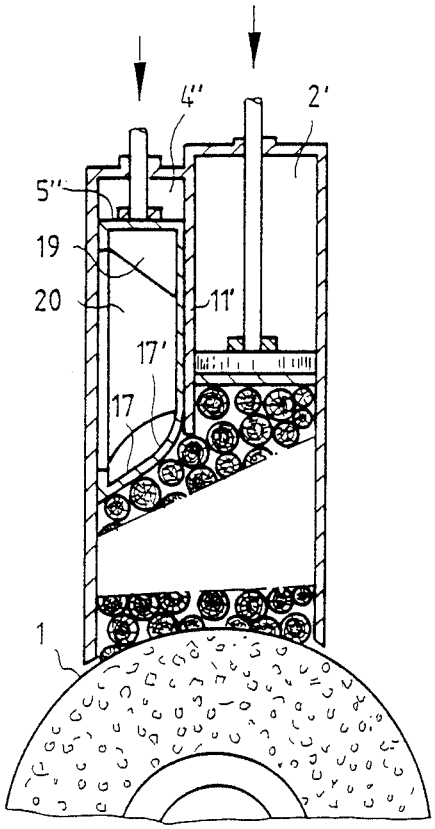
FIG. 4 is a cross section through another embodiment of the wood pulp grinder of the invention.

FIG. 4 shows a variant in which only one auxiliary press chamber 4" and one auxiliary press ram 5" are provided. In this case, the bottom surface 17' of the auxiliary press ram 5" is rounded convexly on its side facing the main press chamber 2 with a large radus which is about 4/5 the width of the auxiliary press chamber 4" or slightly larger, measured in the circumferential direction around the grindstone. Upon the raising of the auxiliary press ram 5", the wood which is then pushed forward by the main press ram 3 or 3' can distribute itself better in the wide grinding housing or magazine and there is no sudden lateral movement of individual bolts of wood. Thus the bolts of wood slide gradually toward the side of the withdrawing auxiliary press ram.

It may be possible to avoid the use of the closure plate 7 if the pressure of the auxiliary press ram can spread less laterally outward because the wall 11' between the main and auxiliary press chambers is extended further downward. This presupposes that the magazine having the full width is relatively long so that the pressure can also spread out over the entire grinding zone. In any event, the embodiment according to FIG. 4 appears to offer advantages in this connection over that of FIG. 1. Furthermore, in this case, the drive mechanism for the auxiliary press ram is also lighter, since only a single auxiliary press ram need be driven. FIG. 4 indicates that the auxiliary press ram can be developed as a laterally open hollow-box construction, i.e. it is open at its ends across the axis of the grindstone. It can be stiffened within the box by ribs 19 and 20.

In general, it may be said that the length of the auxiliary press rams 5, 5', 5" should preferably be at least one-half their total strokes and, at least equal to one-half their active working stroke. The length of the auxiliary press rams preferably even amounts to at least 80% of the active work stroke thereof and may be even the full length of the work stroke, as stated above. In general, the length of the auxiliary press rams will also amount to at least 80% of the total stroke thereof in order to avoid excessive frequency of switching. In order to save material, the hollow construction of the auxiliary press rams of FIG. 1 or the box construction thereof of FIG. 4 is then preferably selected.

The dot-dash lines in FIG. 1 indicate still another embodiment of the wood chute in which the lateral walls are inclined toward each other at an angle of between 5° and 10°. The grindstone is in this version also shown in dot-dash lines below the elongate lateral walls of the chute. The constricting of the chute assures more uniform and stronger pressing of the logs of wood against the grindstone by the press rams. In this case, of course, the wood chute would have to be made relatively long since the lateral walls of the chute must be parallel in the stroke region of the auxiliary rams 5 and 5'. Furthermore, one could then also make the wood chute relatively wide in its wide portion so as to obtain, in its narrow part adjacent the surface of the grindstone, the same length of grinding zone as would be present without the use of the inclined chute walls.

Although the present invention has been described in connection with a plurality of preferred embodiments thereof, many other variations and modifications will now become apparent to those skilled in the art. It is preferred, therefore, that the present invention be limited not by the specific disclosure herein, but only by the appended claims.

What is claimed is:

1. A wood pulp grinder comprising a grinder housing having an open end facing toward a grindstone for delivering wood to be ground to the grindstone;

a main press chamber in the grinder housing spaced above the grindstone; a main press ram guided for movement toward and away from the grindstone through the main press chamber, and when the main press ram is moved away from the grindstone, wood may be loaded into the main press chamber;

an auxiliary press ram at a side of the main press chamber in the grinder housing, the auxiliary press ram having an active end for pressing upon wood in the grinder housing, the auxiliary press ram being movable separately from the main press ram over pressing stroke toward and away from the grindstone;

the main press ram having a first active lower surface for pressing upon wood in the grinder housing and the main press ram having a pressing stroke during which said first active lower surface presses upon wood in the grinder housing and the pressing stroke of the main press ram having an end of motion at which the active surface of the main pressing ram is nearest the grindstone, the auxiliary press ram having a second active surface for pressing upon wood in the grinder housing and the auxiliary press ram having an active stroke during which said second active surface presses upon wood in the grinder housing, the second active surface being located, at least at the beginning of the active stroke of the auxiliary press ram, toward the grindstone, at a height generally near the height of the first active surface of the main press ram at the end of the active stroke of the main press ram where the first active surface is closest to the grindstone;

said auxiliary press ram maintaining pressure upon wood in the grinder housing while the main press ram is moved away from the grindstone to load wood into the main press chamber.

2. The wood pulp grinder of claim 1, wherein the auxiliary press ram is adjacent and alongside the main press ram.

3. The wood pulp grinder of claim 2, wherein the auxiliary press ram has a guide wall oriented for guiding the auxiliary press ram toward and away from the grinding stone and the guide wall is adjacent the main press chamber, and wherein the second active surface of the auxiliary press ram is located, at least at the start of the active pressing stroke of the auxiliary press ram toward the grinding stone, near the end of the guide wall closest to the grindstone.

4. The wood pulp grinder of claim 1, wherein the auxiliary press ram has a length in its direction of movement toward and away from the grinding stone and the length of the auxiliary press ram is at least equal to one-half the length of the active pressing stroke of the auxiliary press ram toward and away from the grindstone.

5. The wood pulp grinder of claim 4, wherein the main ram has a first active pressing stroke toward and away from the grindstone and the auxiliary ram has a respective second active pressing stroke toward and away from the grindstone, and the length of the auxiliary ram is at least one-half as great as the length of the second active pressing stroke.

6. The wood pulp grinder of claim 1, wherein the main ram has a first active pressing stroke toward and away from the grindstone and the auxiliary ram has a respective second active pressing stroke toward and away from the grindstone, and the second active pressing stroke is at least one-half as great in length as the first active pressing stroke.

7. The wood pulp grinder of claim 1, further comprising a closure plate for the main press chamber, located at the end of the main press chamber nearer the grindstone and movable across the main press chamber and across the path of displacement of the main press ram therein for closing the main press chamber against return movement of wood into the main press chamber upon retraction of the main press ram away from the grindstone.

8. The wood pulp grinder of claim 7, wherein the closure plate is supported for motion across the main press chamber on a path perpendicular to the displacement of the main press ram in the main press chamber.

9. The wood pulp grinder of claim 7, wherein the closure plate has a front end with respect to the direction of its advance into and across the main press chamber, and the front end of the closure plate is beveled for easing passage of the closure plate over and past wood in the grinder housing.

10. The wood pulp grinder of claim 9, wherein the front end of the closure plate is provided with teeth for easing its advance across the grinder housing.

11. The wood pulp grinder of claim 1, wherein the second active surface of the auxiliary ram is oriented obliquely, generally along a direction that would be tangent to the grindstone were the second active surface to be moved to the grindstone in the region of the grindstone where a projection of the active surface of the auxiliary ram falls over to the surface of the grindstone, thereby to produce a large component of pressing force by the auxiliary ram toward the axis of the grindstone.

12. The wood pulp grinder of claim 11, wherein the second active surface of the auxiliary ram has a curvature which is convex toward the grindstone with a large radius, at least in the region nearer to the main press chamber.

13. The wood pulp grinder of claim 12, wherein the auxiliary press ram is adjacent the main press ram.

14. The wood pulp grinder of claim 12, wherein the radius of curvature of the second active surface of the auxiliary rams is at least four-fifths of the width of the auxiliary rams, measured circumferentially of the grindstone.

15. The wood pulp grinder of claim 1, further comprising a second auxiliary press ram, and one of the auxiliary press rams being disposed on each side of the main press chamber in the circumferential direction around the grindstone.

16. The wood pulp grinder of claim 15, further comprising simultaneous drives for driving the auxiliary press rams simultaneously toward and away from the grindstone.

17. The wood pulp grinder of claim 15, wherein each of the auxiliary press rams is in the form of a laterally open box, open at the lateral sides thereof which are at opposite ends with respect to and which are across the axis of the grindstone.

18. The wood pulp grinder of claim 1, wherein the auxiliary press ram has a path of movement toward and away from the grindstone and also has a length in the direction of its path toward and away from the grindstone and the length of the auxiliary press ram in the direction of its path of movement toward and away from the grindstone is at least one-half as great as the length of the path of movement of the auxiliary press ram toward and away from the grindstone.

19. The wood pulp grinder of claim 1, further comprising means laterally of the main press chamber for advancing wood into the main press chamber beneath the press ram when the press ram is raised through the press chamber away from the grindstone.

20. The wood pulp grinder of claim 1 in combination with a grindstone supported for rotation around an axis; the grinder housing open end being disposed above the grindstone for supporting wood at the grindstone so that the rotating grindstone will grind the wood supported by the grinder housing at the grindstone.

* * * * *